US010189679B2

(12) United States Patent
Witczak et al.

(10) Patent No.: US 10,189,679 B2
(45) Date of Patent: Jan. 29, 2019

(54) ELEVATOR CAR POWER SUPPLY

(71) Applicant: OTIS ELEVATOR COMPANY, Farmington, CT (US)

(72) Inventors: Tadeusz Pawel Witczak, Bethel, CT (US); Wojciech Szelag, Poznan (PL); Cezary Jedryczka, Lniano (PL); Bryan Robert Siewert, Clinton, CT (US); Zbigniew Piech, Cheshire, CT (US)

(73) Assignee: OTIS ELEVATOR COMPANY, Farmington, CT (US)

( * ) Notice: Subject to any disclaimer, the term of this patent is extended or adjusted under 35 U.S.C. 154(b) by 184 days.

(21) Appl. No.: 15/246,004

(22) Filed: Aug. 24, 2016

(65) Prior Publication Data

US 2017/0057789 A1 Mar. 2, 2017

Related U.S. Application Data

(60) Provisional application No. 62/209,769, filed on Aug. 25, 2015.

(51) Int. Cl.
*B66B 9/00* (2006.01)
*B66B 11/02* (2006.01)

(52) U.S. Cl.
CPC ..... *B66B 11/0273* (2013.01)

(58) Field of Classification Search
CPC ..... B66B 11/0273
USPC ..... 187/249
See application file for complete search history.

(56) References Cited

U.S. PATENT DOCUMENTS 4,402,386 A 9/1983 Ficheux et al.
5,660,249 A * 8/1997 Powell ..... B66B 1/18 182/12
5,732,795 A 3/1998 McCarthy et al.
6,467,585 B1 10/2002 Gozzo et al.
7,479,861 B2 1/2009 Zepke et al.
8,786,135 B2 7/2014 Wang et al.
9,837,860 B2 * 12/2017 McCarthy ..... B66B 1/34
9,926,172 B2 * 3/2018 Fargo ..... B66B 11/0407
(Continued)

FOREIGN PATENT DOCUMENTS

CN 103771220 A 5/2014
GB 2402383 A 12/2004
(Continued)

OTHER PUBLICATIONS

Appunn, Rudiger, et al. "Modern High Speed Elevator Systems for Skyscrapers", 2014, Institute of Electrical Machines, RWTH Aachen University, Aachen, Germany, 15 pages.

*Primary Examiner* — Jeffrey Donels
(74) *Attorney, Agent, or Firm* — Cantor Colburn LLP

(57) ABSTRACT

A ropeless elevator system includes a vertically extending first lane, a vertically extending second lane, and a transfer station extending between and in communication with the first and second lanes. An elevator car is disposed in and is constructed and arranged to move through the transfer station and the first and second lanes. A propulsion system of the elevator system propels the elevator car through at least the first and second lanes and carries a supplemental DC energy storage device for providing supplemental energy to the elevator car during normal operation. A wireless power transfer system of the elevator system is configured to periodically charge the DC energy storage device.

16 Claims, 5 Drawing Sheets

(56) References Cited

U.S. PATENT DOCUMENTS

| | | | | |
|---|---|---|---|---|
| 2002/0023802 | A1* | 2/2002 | Ayano | B66B 1/461 187/290 |
| 2003/0217893 | A1* | 11/2003 | Dunser | B66B 1/2466 187/249 |
| 2006/0163008 | A1 | 7/2006 | Godwin | |
| 2010/0187045 | A1* | 7/2010 | Ishikawa | B66B 1/34 187/290 |
| 2011/0042168 | A1* | 2/2011 | Grundmann | B66B 9/00 187/249 |
| 2011/0192682 | A1* | 8/2011 | Tschuppert | B66B 9/00 187/247 |
| 2013/0206514 | A1 | 8/2013 | Kim et al. | |
| 2014/0002012 | A1* | 1/2014 | McCauley | H02J 7/025 320/108 |
| 2015/0122589 | A1 | 5/2015 | Mezzadri et al. | |
| 2017/0015524 | A1* | 1/2017 | Fargo | B66B 9/003 |
| 2017/0057791 | A1* | 3/2017 | Hsu | B66B 7/00 |
| 2017/0057792 | A1* | 3/2017 | Dwari | B66B 11/0407 |
| 2017/0057793 | A1* | 3/2017 | Dwari | B66B 11/0407 |
| 2018/0016115 | A1* | 1/2018 | Ginsberg | B66B 1/30 |
| 2018/0022574 | A1* | 1/2018 | Pasini | B66B 1/2466 |
| 2018/0022575 | A1* | 1/2018 | Ginsberg | B66B 1/30 |
| 2018/0072419 | A1* | 3/2018 | Burgess | B64D 1/12 |

FOREIGN PATENT DOCUMENTS

| | | | |
|---|---|---|---|
| WO | 2005115906 | A2 | 12/2005 |
| WO | 2010031998 | A1 | 3/2010 |
| WO | 2014126563 | A1 | 8/2014 |
| WO | 2014189492 | A1 | 11/2014 |

* cited by examiner

ELEVATOR CAR POWER SUPPLY

CROSS REFERENCE TO RELATED APPLICATION

This application claims priority to U.S. Provisional Application No. 62/209,769 filed Aug. 25, 2015, the entire contents of which is incorporated herein by reference.

BACKGROUND

The present disclosure relates to elevator systems, and more particularly to supplemental energy storage devices in an elevator car of the elevator system.

Self-propelled elevator systems, also referred to as ropeless elevator systems, are useful in certain applications (e.g., high rise buildings) where the mass of the ropes for a roped system is prohibitive and/or there is a need for multiple elevator cars in a single hoistway. Elevator cars typically need power for ventilation, lighting systems, control units, communication units and to recharge batteries installed, for example, on an elevator car controller. Moreover, elevator cars may require back-up systems in case of a power failure. Existing systems use moving cables or current collectors/sliders to connect a moving elevator car with power lines distributed along the elevator hoistway.

SUMMARY

A ropeless elevator system according to one, non-limiting, embodiment of the present disclosure includes a vertically extending first lane; a vertically extending second lane; a transfer station extending between and in communication with the first and second lanes; a first elevator car disposed in and arranged to move through the transfer station and the first and second lanes; a propulsion system for propelling the first elevator car through at least the first and second lanes; a first DC energy storage device carried by the first elevator car and configured to provide supplemental power to the elevator car during normal operation; and a wireless power transfer system configured to periodically charge the first DC energy storage device.

Additionally to the foregoing embodiment, the first DC energy storage device includes a plurality of batteries and a circuit for cell balancing.

In the alternative or additionally thereto, in the foregoing embodiment, the plurality of batteries are lithium batteries.

In the alternative or additionally thereto, in the foregoing embodiment, the ropeless elevator system includes a power source; and a conductor at least partially in the transfer station and extending from the power source and configured to releasably mate with the first DC energy storage device for charging when the first elevator car is in the transfer station.

In the alternative or additionally thereto, in the foregoing embodiment, the first DC energy storage device is a supercapacitor.

In the alternative or additionally thereto, in the foregoing embodiment, the ropeless elevator system includes a second DC energy storage device configured to provide power to the first elevator car during power failure.

In the alternative or additionally thereto, in the foregoing embodiment, the wireless power transfer system is configured to charge the first DC energy storage device only when needed to preserve the life of the first DC energy storage device.

In the alternative or additionally thereto, in the foregoing embodiment, the first DC energy storage device is configured to provide power to at least one of the second DC energy storage device, a ventilation unit, a lighting system, a control unit, a communication unit, and a braking system of the elevator car.

In the alternative or additionally thereto, in the foregoing embodiment, the first DC energy storage device is configured to provide power to at least one of a ventilation unit, a lighting system, a control unit, a communication unit, a door actuator, and a braking system of the first elevator car.

In the alternative or additionally thereto, in the foregoing embodiment, the ropeless elevator system includes a service zone in communication with at least one of the transfer station, the first lane and the second lane, and being constructed and arranged to house the first elevator car for service; a power source; and a conductor at least partially disposed in the service zone, extending from the power source, and configured to releasably mate with the first DC energy storage device for charging when the first elevator car is in the service zone.

In the alternative or additionally thereto, in the foregoing embodiment, the first DC energy storage device is constructed and arranged to be removable and replaced with a charged DC energy storage device when the first elevator car is in the transfer station.

In the alternative or additionally thereto, in the foregoing embodiment, the ropeless elevator system includes a second elevator car disposed in and constructed and arranged to move through the transfer station and the first and second lanes; and a second DC energy storage device carried by the second elevator car that varies in size from the first DC energy storage device.

A method of maintaining a DC energy storage device of an elevator car according to another, non-limiting, embodiment includes periodically charging the DC energy storage device via a wireless power transfer system when the elevator car is in normal use; and charging the DC energy storage device via a conductor and power source when the elevator car is not in normal use.

Additionally to the foregoing embodiment, the DC energy storage device is a supplemental storage device.

In the alternative or additionally thereto, in the foregoing embodiment, the elevator car is in the transfer station when charging the DC energy storage device via the conductor.

In the alternative or additionally thereto, in the foregoing embodiment, the method includes balancing cells of a plurality of batteries of the DC energy storage device via a circuit of the DC energy storage device.

The foregoing features and elements may be combined in various combinations without exclusivity, unless expressly indicated otherwise. These features and elements as well as the operation thereof will become more apparent in light of the following description and the accompanying drawings. However, it should be understood that the following description and drawings are intended to be exemplary in nature and non-limiting.

BRIEF DESCRIPTION OF THE DRAWINGS

Various features will become apparent to those skilled in the art from the following detailed description of the disclosed non-limiting embodiments. The drawings that accompany the detailed description can be briefly described as follows.

DETAILED DESCRIPTION

The following patent applications assigned to the same assignee and filed on the same day as the present disclosure are herein incorporated by reference in their entirety Nos. 62/209,818, 62/209,814, 62/207,761, 62/209,775.

Figure 1:
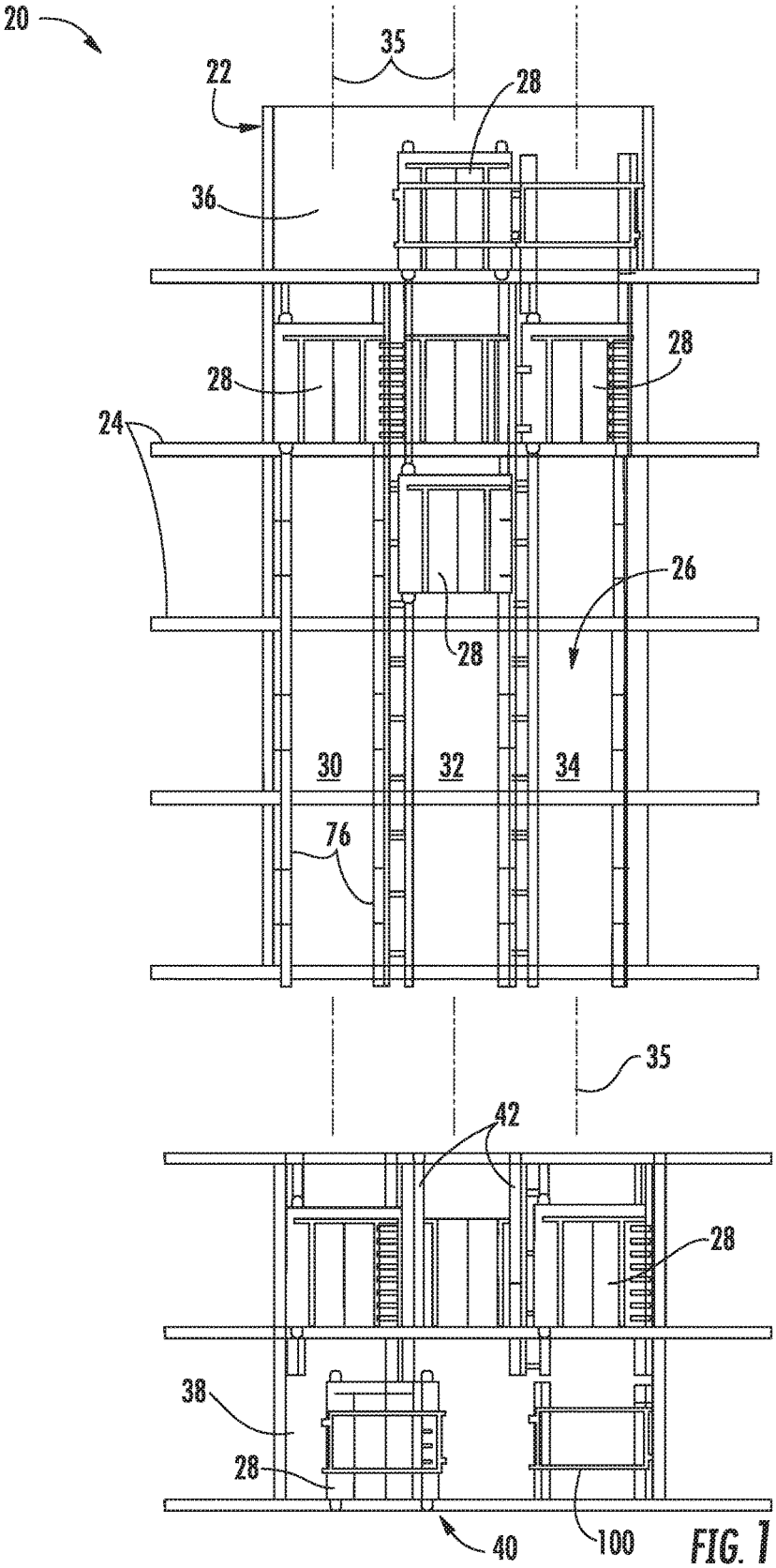
FIG. 1 depicts a multicar elevator system in an exemplary embodiment.

FIG. 1 depicts a self-propelled or ropeless elevator system 20 in an exemplary embodiment that may be used in a structure or building 22 having multiple levels or floors 24. Elevator system 20 includes a hoistway 26 having boundaries defined by the structure 22 and at least one car 28 adapted to travel in the hoistway 26. The hoistway 26 may include, for example, three lanes 30, 32, 34 each extending along a respective central axis 35 with any number of cars 28 traveling in any one lane and in any number of travel directions (e.g., up and down). For example and as illustrated, the cars 28 in lanes 30, 34, may travel in an up direction and the cars 28 in lane 32 may travel in a down direction.

Above the top floor 24 may be an upper transfer station 36 that facilitates horizontal motion to elevator cars 28 for moving the cars between lanes 30, 32, 34. Below the first floor 24 may be a lower transfer station 38 that facilitates horizontal motion to elevator cars 28 for moving the cars between lanes 30, 32, 34. It is understood that the upper and lower transfer stations 36, 38 may be respectively located at the top and first floors 24 rather than above and below the top and first floors, or may be located at any intermediate floor. Yet further, the elevator system 20 may include one or more intermediate transfer stations (not illustrated) located vertically between and similar to the upper and lower transfer stations 36, 38.

Figure 2:
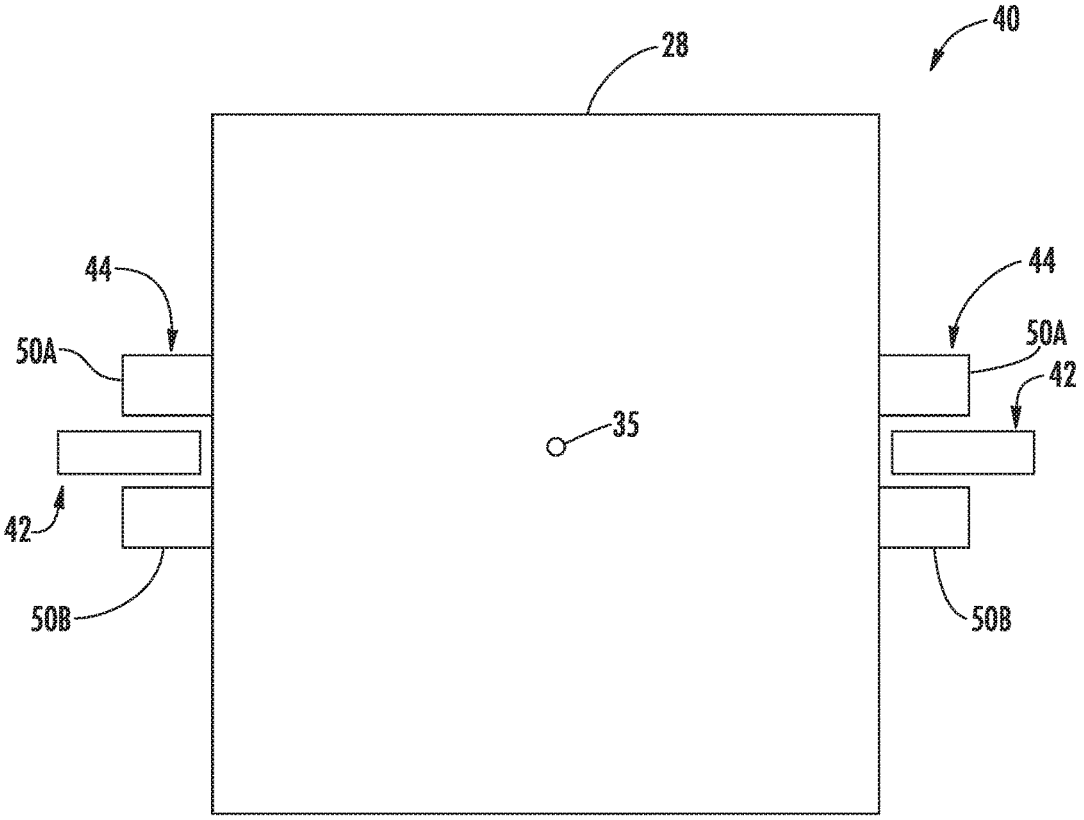
FIG. 2 is a top down view of a car and portions of a linear propulsion system in an exemplary embodiment.
Figure 3:
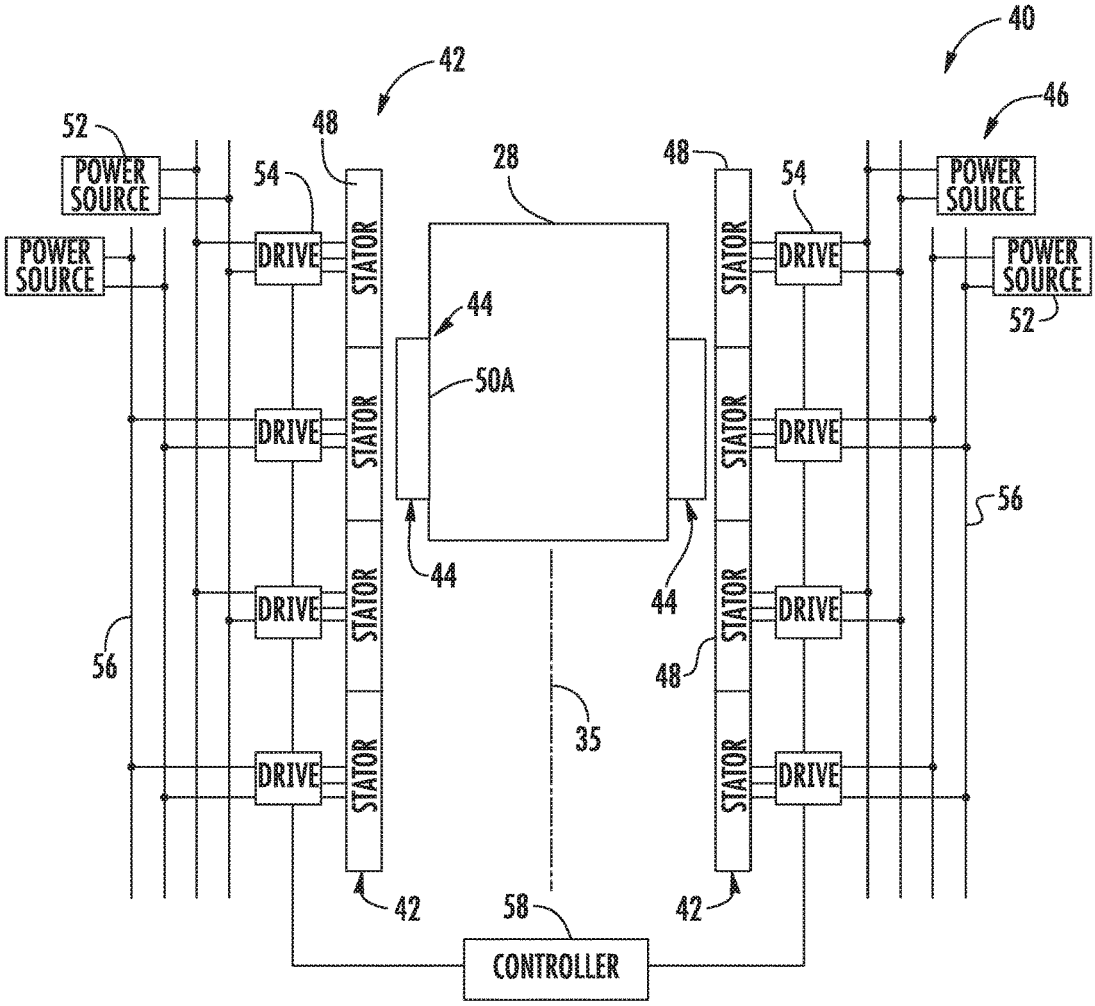
FIG. 3 is a schematic of the linear propulsion system.

Referring to FIGS. 1 through 3, cars 28 are propelled using a linear propulsion system 40 having at least one, fixed, primary portion 42 (e.g., two illustrated in FIG. 2 mounted on opposite sides of the car 28), moving secondary portions 44 (e.g., two illustrated in FIG. 2 mounted on opposite sides of the car 28), and a control system 46. The primary portion 42 includes a plurality of windings or coils 48 mounted at one or both sides of the lanes 30, 32, 34 in the hoistway 26. Each secondary portion 44 includes two rows of opposing permanent magnets 50A, 50B mounted to the car 28. Primary portion 42 is supplied with drive signals from the control system 46 to generate a magnetic flux that imparts a force on the secondary portions 44 to control movement of the cars 28 in their respective lanes 30, 32, 34 (e.g., moving up, down, or holding still). The plurality of coils 48 of the primary portion 42 are generally located between and spaced from the opposing rows of permanent magnets 50A, 50B. It is contemplated and understood that any number of secondary portions 44 may be mounted to the car 28, and any number of primary portions 42 may be associated with the secondary portions 44 in any number of configurations.

Referring to FIG. 3, the control system 46 may include power sources 52, drives 54, buses 56 and a controller 58. The power sources 52 are electrically coupled to the drives 54 via the buses 56. In one non-limiting example, the power sources 52 may be direct current (DC) power sources. DC power sources 52 may be implemented using storage devices (e.g., batteries, capacitors), and may be active devices that condition power from another source (e.g., rectifiers). The drives 54 may receive DC power from the buses 56 and may provide drive signals to the primary portions 42 of the linear propulsion system 40. Each drive 54 may be a converter that converts DC power from bus 56 to a multiphase (e.g., three phase) drive signal provided to a respective section of the primary portions 42. The primary portion 42 is divided into a plurality of modules or sections, with each section associated with a respective drive 54.

The controller 58 provides control signals to each of the drives 54 to control generation of the drive signals. Controller 58 may use pulse width modulation (PWM) control signals to control generation of the drive signals by drives 54. Controller 58 may be implemented using a processor-based device programmed to generate the control signals. The controller 58 may also be part of an elevator control system or elevator management system. Elements of the control system 46 may be implemented in a single, integrated module, and/or be distributed along the hoistway 26.

Figure 4:
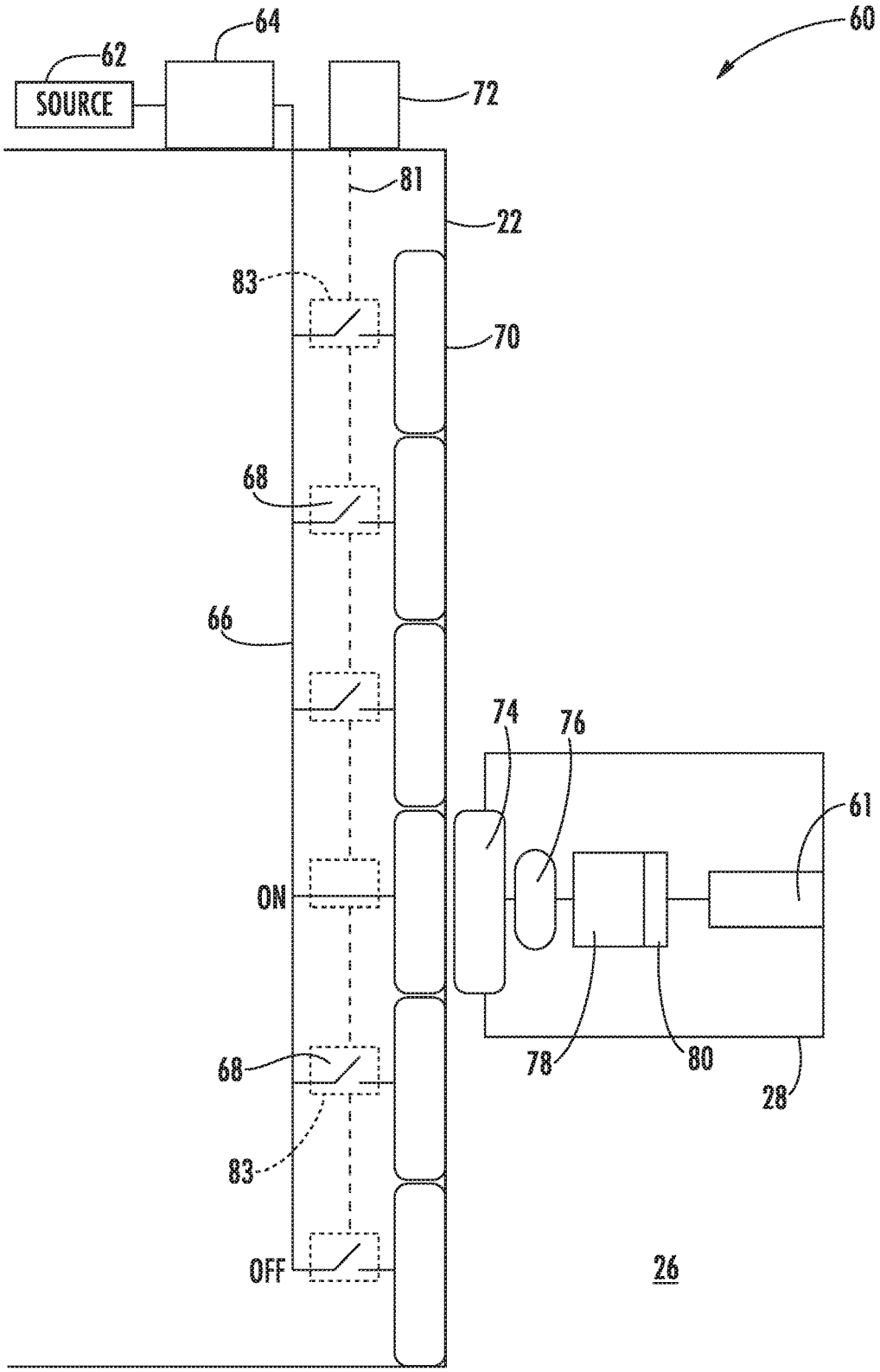
FIG. 4 is a schematic of a wireless power transfer system of the elevator system.

Referring to FIG. 4, a wireless power transfer system 60 of the elevator system 20 may be used to power loads 61 in or on the elevator car 28. The power transfer system 60 may be an integral part of the control system 46 thereby sharing various components such as the controller 58, buses 56, power source 52 and portions of the linear propulsion system 40 such as the primary portion 42 and other components. Alternatively, the wireless power transfer system 60 may generally be independent of the control system 46 and/or linear propulsion system 40. The power loads 61 may be alternating current (AC) loads utilizing a traditional power frequency such as, for example, about 60 Hz. Alternatively, or in addition thereto, the loads 61 may include direct current (DC) loads.

The wireless power transfer system 60 may include a power source 62, a converter 64 that may be a high frequency converter, at least one conductor 66 for transferring power (e.g., high frequency power) from the converter 64, a plurality of switches 68, and a plurality of primary resonant coils 70 that may generally be the primary portion 42. Each one of the primary resonant coils 70 are associated with a respective one of the plurality of switches 68. The power transfer system 60 may further include a controller 72 that may be part of the controller 58. The controller 72 may be configured to selectively and sequentially place and/or maintain the switches 68 in an off position (i.e., circuit open) and/or in an on position (i.e., circuit closed). The power source 62 may be the power source 52 and may further be of a DC or of an AC type with any frequency (i.e. low or high).

The converter 64 may be configured to convert the power outputted by the power source 62 to a high frequency power for the controlled and sequential energization of the primary resonant coils 70 by transmitting the high frequency power through the conductors 66. More specifically, if the power source 62 is a DC power source, the converter 64 may convert the DC power to an AC power and at a prescribed high frequency. If the power source 62 is an AC power source with, for example, a low frequency such as 60 Hz, the converter 64 may increase the frequency to a desired high frequency value. For the present disclosure, a desired high frequency may fall within a range of about 1 kHz to 1 MHz, and preferably within a range of about 250 kHz to 300 kHz.

The wireless power transfer system 60 may further include components generally in or carried by the elevator car 28. Such components may include a secondary resonant coil 74 configured to induce a current when an energized primary resonant coil 70 is proximate thereto, a resonant component 76 that may be active and/or passive, a power converter 78, and an energy storage device 80 that may be utilized to power the DC loads 61. The secondary resonant coil 74 may induce a current when the coil is proximate to an energized primary resonant coil 74. The primary resonant coil 70 is energized when the respective switch 68 is closed based on the proximity of the elevator car 28 and secondary resonant coil 74.

Each switch 68 may be controlled by the controller 72 over pathway 81 that may be hard-wired or wireless. Alternatively, or some combination thereof, the switches 68 may be smart switches each including a sensor 83 that senses a parameter indicative of the proximity of the secondary resonant coil 74. For example, the sensor 83 may be an inductance sensor configured to sense a change of inductance across the associated primary resonant coil 70 indicative of a proximate location of the secondary resonant coil 74. Alternatively, the sensor 83 may be a capacitance sensor configured to sense a change of capacitance across the associated primary resonant coil 70 indicative of a proximate location of the secondary resonant coil 74. In another embodiment, the controller 72 may assume limited control and the switches 68 may still be smart switches. For example, the controller 72 may control the duration that a given switch remains closed; however, the switches are 'smart' in the sense that they may be configured to move to the closed position without the controller instruction to do so.

The AC voltage induced across the secondary resonant coil 74 is generally at the high frequency of the primary resonant coil 70. The ability to energize the primary resonant coils 70 with the high frequency power (i.e., as oppose to low frequency) may optimize the efficiency of induced power transfer from the primary resonant coil 70 to the secondary resonant coil 74. Moreover, the high frequency power generally facilitates the reduction in size of many system components such as the coils 70, 74, the resonant component 76 and the converter 78 amongst others. Reducing the size of components improves packaging of the system and may reduce elevator car 28 weight. The international patent application WO 2014/189492 published under the Patent Cooperation Treaty on Nov. 27, 2014, filed on May 21, 2013, and assigned to Otis Elevator Company of Farmington, Conn., is herein incorporated by reference in its entirety.

The resonant component 76 may be passive or active. As a passive resonant component 76, the component is generally a capacitor and capable of storing AC power. As an active resonant component 76, the component 76 is configured to mitigate the effects of a weak or variable coupling factor (i.e., varies when the secondary resonant coil 74 passes between primary resonant coils 70). That is, the resonant component 76 may function to level-out the output current and voltage from the secondary resonant coil 74.

The power converter 78 is configured to receive high frequency power from the resonant component 76. The converter 78 may reduce the high frequency power to a low frequency power (e.g., 60 Hz or other) that is compatible with AC loads 61 in the elevator car 28. The converter 78 may further function to convert the high frequency power to DC power, which is then stored in the energy storage device 80. An example of an energy storage device may be a type of battery.

Figure 5:
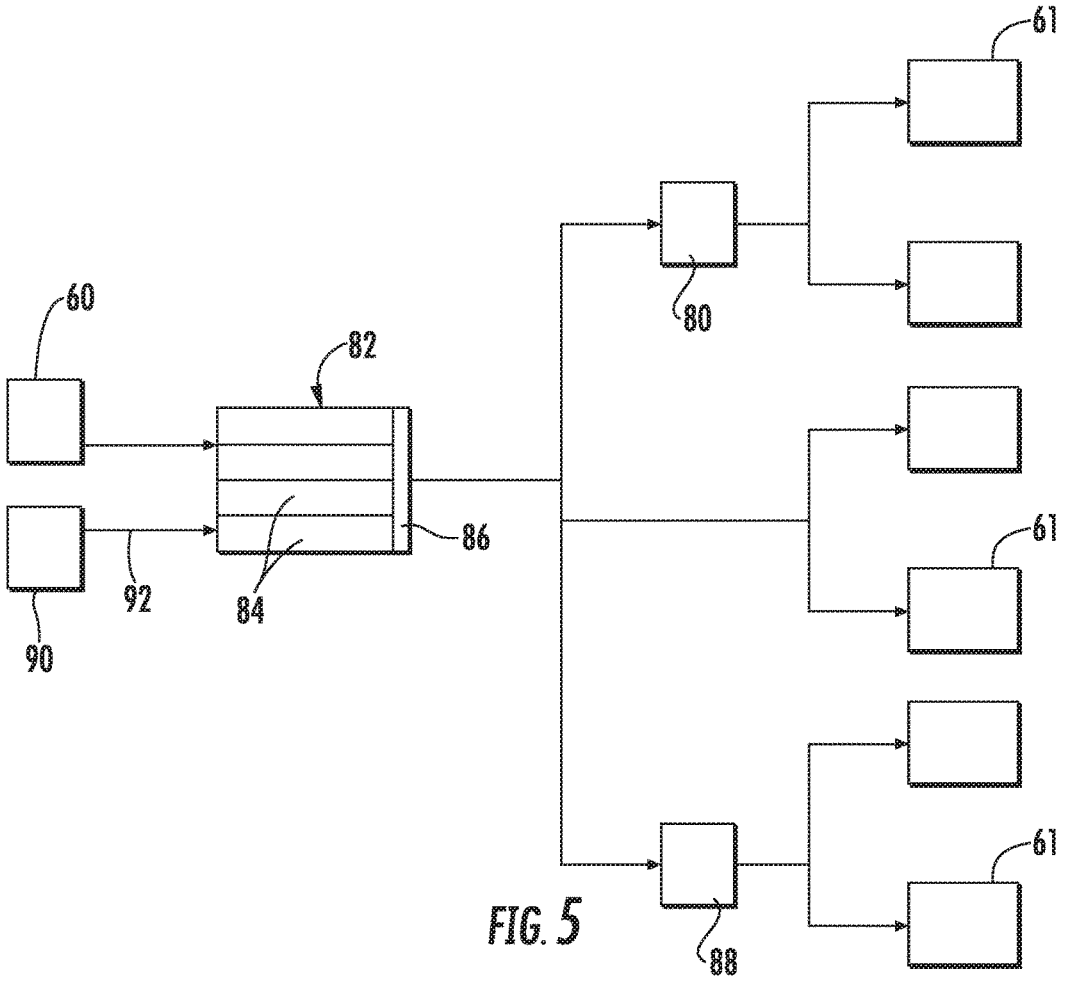
FIG. 5 is a schematic of a supplemental energy storage device and loads of the elevator system.

Referring to FIG. 5, the elevator system 20 further includes a second energy storage device 82 that may, as one non-limiting example, provide supplemental or secondary power to the loads 61 of the elevator car 28 when the charging circuits are not sufficient. Storage device 82 may include a plurality of batteries 84 and a circuit 86 for balancing energy between cells. The batteries 84 may be of a lithium type or other type characterized by high capacity, high energy density and a short charging time. Alternatively, the storage device 82 may include supercapacitors with a high energy capacity capable of supplementing any deficiency in energy during normal operation.

The loads 61 relative to the second energy storage device 82 may include the first energy storage device 80, a ventilation unit, a lighting system, a control unit, a communication unit, door actuators, an elevator car braking system, and other loads. The loads 61 may require AC or DC power. During a power outage scenario, some loads 61 may obtain power from the storage device 80 that, in-turn, may receive limited supplemental power from the storage device 82. Alternatively or in addition thereto, some loads 61 may receive DC power directly from the supplemental energy storage device 82. For loads 61 requiring DC power, the storage device 80 and/or the supplemental energy storage device 82 may transmit DC power to an inverter 88 that outputs AC power at a desired frequency.

Figure 6:
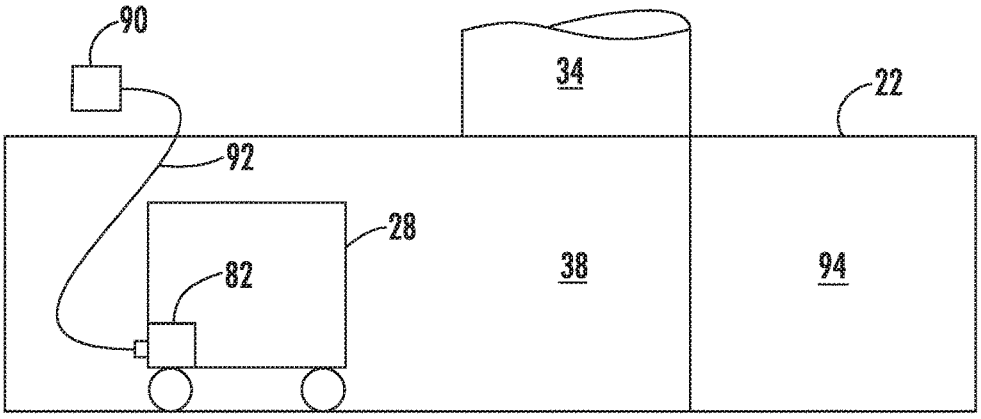
FIG. 6 is a side view of a transfer station of the elevator system.

During normal elevator car 28 operation, the loads 61 may not draw power from the back-up energy storage device 82, and instead, may draw power as previously described. The supplemental energy storage device 82 may maintain a minimal level of charge so as not to limit the life of the device via periodic charging by the wireless power transfer system 60 and/or as dictated by power management algorithm(s) conducted by, for example, the controller 58. As best shown in FIG. 6, additional or full charging of the supplemental energy storage device 82 may be facilitated while the elevator car 28 is in the transfer station 38 (i.e., not normal operation). That is, when the elevator car 28 is in the transfer station 38 for a known duration, the time needed to fully charge the supplemental energy storage device 82 may be realized. Such charging may be accomplished by drawing power from a power source 90, over a conductor or cable 92, and to the device 82. The cable 92 may be at least partially in the transfer station 38 and is capable of being connected and disconnected from the device 82 (e.g., a plug connection). It is further contemplated and understood, that recharging of the energy storage device 82 may be conducted at any previously designated floor 24 setup with a cable 92, and when the car 28 is stopped for the necessary period of time to perform the recharging operation.

The supplemental energy storage device 82 may also be charged utilizing the power source 90 and a cable 92 from a service zone 94 location having boundaries generally defined by the structure 22 and communicating with at least one of the transfer stations 36, 38 and lanes 30, 32, 34. It is further contemplated and understood that the storage device 82 or batteries 84 may simply be interchanged while the elevator car 28 resides in the transfer station 38.

Although the present disclosure illustrates one example of a linear motor and one example of a wireless power transfer system 60, the supplemental energy storage device 82, and method of charging, may be applicable to any variety of ropeless elevator systems having any number of different means to wirelessly transfer power to the elevator car during normal operation. Furthermore, the energy storage devices 82 may be of different sizes from one elevator car 28 to the next of the same elevator system 20. For example, elevator cars that are designated to perform specific and/or special tasks may require a different energy storage device size (i.e. amount of energy storage) than another car.

While the present disclosure is described with reference to exemplary embodiments, it will be understood by those skilled in the art that various changes may be made and equivalents may be substituted without departing from the spirit and scope of the present disclosure. In addition, various modifications may be applied to adapt the teachings of the present disclosure to particular situations, applications, and/or materials, without departing from the essential scope thereof. The present disclosure is thus not limited to the particular examples disclosed herein, but includes all embodiments falling within the scope of the appended claims.

What is claimed is:

1. A ropeless elevator system, comprising:

a vertically extending first lane;

a vertically extending second lane;

a transfer station extending between and in communication with the first and second lanes;

a first elevator car disposed in and arranged to move through the transfer station and the first and second lanes;

a propulsion system for propelling the first elevator car through at least the first and second lanes;

a first DC energy storage device carried by the first elevator car and configured to provide supplemental power to the elevator car during normal operation; and a wireless power transfer system configured to periodically charge the first DC energy storage device.

2. The ropeless elevator system set forth in claim 1, wherein the first DC energy storage device includes a plurality of batteries and a circuit for cell balancing.

3. The ropeless elevator system set forth in claim 2, wherein the plurality of batteries are lithium batteries.

4. The ropeless elevator system set forth in claim 1 further comprising:

a power source; and a conductor at least partially in the transfer station and extending from the power source and configured to releasably mate with the first DC energy storage device for charging when the first elevator car is in the transfer station.

5. The ropeless elevator system set forth in claim 1, wherein the first DC energy storage device is a supercapacitor.

6. The ropeless elevator system set forth in claim 1 further comprising:

a second DC energy storage device configured to provide power to the first elevator car during power failure.

7. The ropeless elevator system set forth in claim 1, wherein the wireless power transfer system is configured to charge the first DC energy storage device only when needed to preserve the life of the first DC energy storage device.

8. The ropeless elevator system set forth in claim 6, wherein the first DC energy storage device is configured to provide power to at least one of the second DC energy storage device, a ventilation unit, a lighting system, a control unit, a communication unit, and a braking system of the elevator car.

9. The ropeless elevator system set forth in claim 1, wherein the first DC energy storage device is configured to provide power to at least one of a ventilation unit, a lighting system, a control unit, a communication unit, a door actuator, and a braking system of the first elevator car.

10. The ropeless elevator system set forth in claim 1 further comprising:

a service zone in communication with at least one of the transfer station, the first lane and the second lane, and being constructed and arranged to house the first elevator car for service;

a power source; and a conductor at least partially disposed in the service zone, extending from the power source, and configured to releasably mate with the first DC energy storage device for charging when the first elevator car is in the service zone.

11. The ropeless elevator system set forth in claim 1, wherein the first DC energy storage device is constructed and arranged to be removable and replaced with a charged DC energy storage device when the first elevator car is in the transfer station.

12. The ropeless elevator system set forth in claim 1 further comprising:

a second elevator car disposed in and constructed and arranged to move through the transfer station and the first and second lanes; and a second DC energy storage device carried by the second elevator car that varies in size from the first DC energy storage device.

13. A method of maintaining a DC energy storage device of an elevator car comprising:

periodically charging the DC energy storage device via a wireless power transfer system when the elevator car is traveling in a hoistway; and charging the DC energy storage device via a conductor and power source when the elevator car is not traveling in the hoistway.

14. The method set forth in claim 13, wherein the DC energy storage device is a supplemental storage device applied when the wireless power transfer system is insufficient to power the elevator car.

15. The method set forth in claim 13, wherein the elevator car is in a transfer station when charging the DC energy storage device via the conductor.

16. The method set forth in claim 13 further comprising:

balancing cells of a plurality of batteries of the DC energy storage device via a circuit of the DC energy storage device.

* * * * *